US010710770B2

(12) United States Patent
Kögel et al.

(10) Patent No.: US 10,710,770 B2
(45) Date of Patent: Jul. 14, 2020

(54) STACKABLE CONTAINER SYSTEM

(71) Applicant: BS Systems GmbH & Co. KG, Zusmarshausen (DE)

(72) Inventors: Jan Kögel, Zusmarshausen (DE); Reiner Gonitianer, Dillingen (DE)

(73) Assignee: BS Systems GmbH & Co. KG, Zusmarshausen (DE)

( * ) Notice: Subject to any disclaimer, the term of this patent is extended or adjusted under 35 U.S.C. 154(b) by 31 days.

(21) Appl. No.: 16/048,562

(22) Filed: Jul. 30, 2018

(65) Prior Publication Data

US 2019/0039781 A1 Feb. 7, 2019

(30) Foreign Application Priority Data

Aug. 7, 2017 (DE) ..... 10 2017 117 823

(51) Int. Cl.

| | |
|---|---|
| ***B65D 21/032*** | (2006.01) |
| ***B65D 21/02*** | (2006.01) |
| ***A45C 5/00*** | (2006.01) |
| ***B25H 3/02*** | (2006.01) |

(52) U.S. Cl.

CPC ..... *B65D 21/0212* (2013.01); *A45C 5/00* (2013.01); *B25H 3/02* (2013.01); *B65D 21/0209* (2013.01)

(58) Field of Classification Search

CPC ..... B65D 21/0212; B65D 21/0209; B65D 21/0227; A45C 5/00; B25H 3/02

See application file for complete search history.

(56) References Cited

U.S. PATENT DOCUMENTS

| | | | | |
|---|---|---|---|---|
| RE47,022 | E * | 9/2018 | Sosnovsky | B25H 3/02 |
| 2019/0308772 | A1* | 10/2019 | Gonitianer | B25H 3/02 |
| 2019/0315515 | A1* | 10/2019 | Gonitianer | B25H 3/02 |

FOREIGN PATENT DOCUMENTS

| | | |
|---|---|---|
| DE | 102013110496 A1 | 3/2015 |
| DE | 202015005752 U1 | 11/2016 |

OTHER PUBLICATIONS

Search result of examination report of German Application No. 10 2017 117 823.6 filed Aug. 7, 2017.

* cited by examiner

*Primary Examiner* — Stephen J Castellano

(74) *Attorney, Agent, or Firm* — Paul D. Bianco; Stephen Bongini; Fleit Intellectual Property Law

(57) ABSTRACT

A stackable container system includes at least two coupling hooks disposed on oppositely lying side walls of the container system for connecting the coupling hooks with associated coupling recesses of another container system. The coupling hooks move between a coupled position, in which the coupling hooks are engaged in the coupling recesses, and a detached position, in which the coupling hooks are disengaged from the coupling recesses. The coupling recesses are disposed within a wall that extends beyond the upper surface of the container system. After placement of the container system on top of the other container system, one of the coupling hooks can be inserted in the horizontal direction into the associated coupling recess of the other container system. The oppositely lying coupling hook can be subsequently vertically pushed into the associated coupling recess of the other container system.

11 Claims, 1 Drawing Sheet guide shaft has no inside wall

STACKABLE CONTAINER SYSTEM

FIELD OF THE INVENTION

The present invention relates to a stackable container system.

BACKGROUND

DE 10 2013 110 496 describes a stackable container system with two coupling hooks disposed on two oppositely lying sides for engaging said coupling hooks in associated coupling recesses of another container system of the same type. In this container system, the coupling hooks are able to move between a coupled position in which the coupling hooks are engaged in the coupling recess and a detached position in which the coupling hooks are disengaged from the coupling recesses. The coupling recesses are disposed within a wall that extends beyond the upper surface of the container system. This wall forms part of the side walls of a lower container part of the container system. After alignment of a plurality of container systems, these containers can be rigidly but detachably connected to each other by means of the coupling elements. This type of positive locking fit and/or frictional connection allows a plurality of container systems connected to each other to be comfortably carried with one hand.

The subject matter of DE 20 2015 005 752 relates to a stackable case having a coupling connection to another case that can be placed on top of the first case and with a locking slide that can be actuated by placing the upper case to be stacked on top of the lower case. Provided are two coupling hooks, which are simultaneously moved in the horizontal direction for being locked in the ratcheted position, with a spring, which is also simultaneously pushed down.

DE 10 2013 110 496 A1 discloses a closure for a container having two container parts, which closure is disposed on a first container part and comprises connecting means for the detachable connection to complementary additional connecting means of the second container part.

A disadvantage of the container system mentioned above is the requirement that in order to establish a connection, two superjacent container systems must be positioned in precise alignment with each other.

SUMMARY

One aspect of the disclosure relates to a stackable container system in which two container systems of the same type can be connected as quickly and intuitively as possible to each other.

Useful embodiments are also disclosed.

Thus, the present invention provides that after placement of the container system on top of another container system of the same type, one of the coupling hooks can be inserted in the horizontal direction into the associated coupling recess of the other container system and that the oppositely lying coupling hook can subsequently be pushed vertically into the associated coupling recess of the other container system.

In addition, the invention provides for the container system to comprise a lower container part and a cover and for the wall to form part of the side walls of the lower container part.

In an alternative embodiment, the wall forms part of the cover.

In addition, the actuation of the coupling hook from the coupled position to the detached position can take place against the action of at least one spring.

In the region of the wall, the cover can be designed to flatten out toward the wall.

Each coupling hook and each associated coupling recess can be designed in two parts, and both parts of the coupling hooks can be actuated via a shared actuation surface.

The cover can be pivotably mounted on the lower container part.

In addition, disposed between the two parts of the coupling hooks can be a guide lug that is immobile with respect to the lower container part and that, during the coupling of two containers, engages in a guide shaft that is disposed between the coupling recesses.

BRIEF DESCRIPTION OF THE DRAWINGS

A practical example of the present invention will be explained in greater detail with reference to the attached drawings. The drawings show.

DETAILED DESCRIPTION

Figure 1:
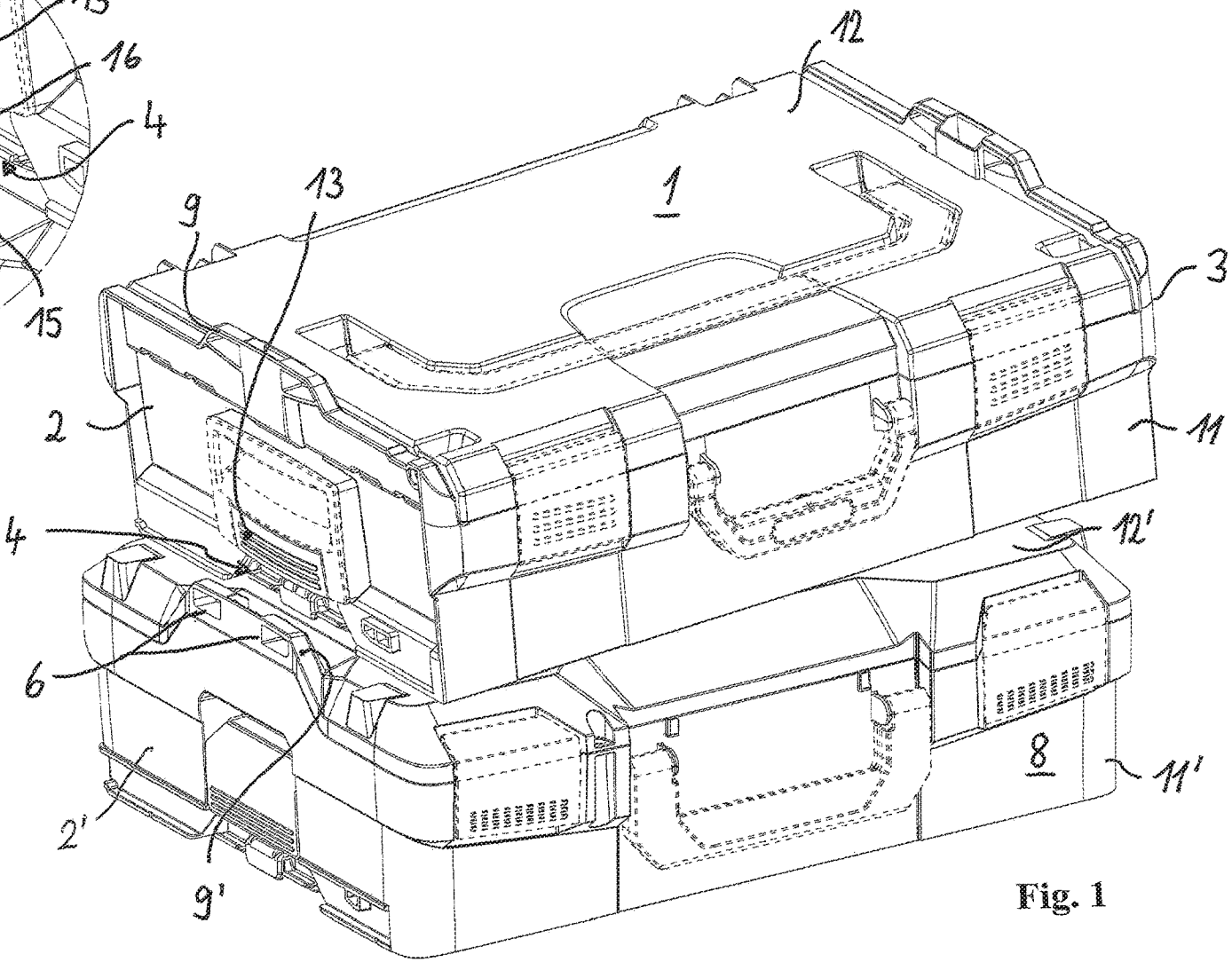
FIG. 1: Two container systems of the same type at the start of the coupling procedure.

FIG. 1 shows two stackable container systems 1 and 8 of the same type but different in their design details. The difference between the two container systems is that in the top container 1, the cover 12 is disposed between the two side walls 2 and 3 and that, when the container system is closed, the side walls 2 and 3 extend beyond the cover 12, whereas in the bottom container system 8, the side walls, and in particular the wall 9' that extends beyond the upper surface of the container system 8, form part of the cover 12'. Each of the container systems 1 and 8 has two coupling hooks 4 disposed on oppositely lying side walls 2 and 3. As especially readily visible in the detail view of FIG. 2, these coupling hooks, as far as coupling is concerned, interact with associated coupling recesses 6 of the other container system 8 of the same type. These coupling recesses are disposed within a wall 9 and 9', respectively, which wall extends beyond the upper surface of the container system 1 and which in the top container system 1 forms part of the side walls 2 and 3 and in the bottom container system 8 part of the cover 12'.

Each of the two coupling hooks 4 has two parts 14 and 15 in the shape of the actual hooks of the coupling hooks 4, which two parts can be jointly actuated via a shared actuation surface 13 of each coupling hook 4. To implement this, the coupling hook 4 can be moved against the action of a spring (not shown in the drawings) from the coupled position into the detached position when the shared actuation surface 13 of the two parts 14 and 15 of the coupling hook 4 is pushed in the direction of the first container system 1.

As the figures indicate, the cover 12 and 12' of each container system 1 and 8 is pivotably mounted on the lower part 11 and 11' of the container.

Disposed between the two parts 14 and 15 of each coupling hook 4 is a guide lug 16 that is stationarily mounted on the lower part of the container 11, i.e., the guide lug does not move when the coupling hook 4 is actuated via the actuation surface 13. This guide lug 16 can be used for insertion into a guide shaft 17 on the other container system 8, with the guide shaft 17 being positioned between the two coupling recesses 6. The guide shaft 17 has three walls, i.e., one outside wall and two side walls, but no inside wall. Thus, the guide shaft 17 is open toward the inside of the container system 1 so that the guide lug 16 can be inserted into the guide shaft 17 from the side.

The method of coupling two container systems according to the present invention will be described below.

Figure 2:
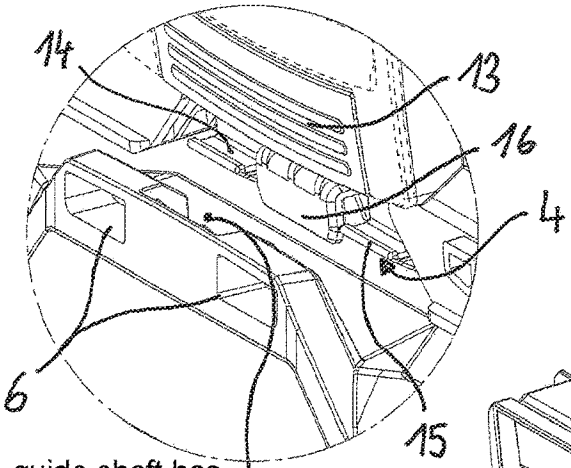
FIG. 2: A detail of FIG. 1.

A lower side edge of the stackable container system 1 shown at the top in FIGS. 1 and 2, above which lower side edge a coupling hook 4 is disposed, is placed on top of the cover 12' of a subjacent container system 8 of the same type. Subsequently, the top container system 1 is moved sideways via the above-mentioned side edge on the cover 12' of the bottom container system 8, i.e., in the direction of the wall 2' of the bottom container system until the guide lug 16 of the top container system 1 engages in the guide shaft 17 of the bottom container system 8. In this position, the two parts 14 and 15 of the coupling hook 4 of the top container system 1 engage in the associated coupling recesses 6 of the bottom container system 8, without requiring actuation of the actuation surface 13 because the top container system 1 is tilted relative to the bottom container system 8 and therefore allows the coupling hook 4 to engage in the coupling recess 6 of the bottom container system 8 without actuation of the actuation surface 13.

Once the container system 1, either through contact of the guide lug 16 with the guide shaft 17 of the other container system 8 or through contact of the coupling hook 4 with the coupling recess 6 of the other container system 8, is in position, the still upwardly tilting opposite side of the container system 1 can be pushed downwardly in the direction of the other container system 8, i.e., it can be moved in the vertical direction toward the other container system 8. This causes the guide lug disposed on the opposite side to engage in the associated guide shaft of the other container system, and the associated coupling hook engages the coupling recess from behind. The spring is actuated, and both parts of the coupling hook engage in the two associated parts of the coupling recess.

To detach the container system 1 from the other container system 8, both actuation surfaces 13 of the two coupling hooks 4 can be simultaneously actuated, and the top container system 1 can subsequently be vertically lifted off the other container system 8 after the coupling hooks 4 have been pushed out of the coupling recesses 6. Or, as an alternative, it is possible to actuate only one actuation surface 13, which causes the associated coupling hook to be pushed out of the associated coupling recess. Subsequently, the top container system 1 can be lifted slightly upward and, by simply pulling out the coupling hook 4 in the horizontal direction, which coupling hook is still engaged in the associated coupling recess 6, can be detached and subsequently removed by lifting it off the top.

In contrast to the prior-art container systems mentioned above, the present invention offers the advantage that intuitive coupling is possible. The reason is that it is no longer necessary to vertically position the top container system precisely in alignment onto the bottom container system. This is due to the fact that in contrast to the container systems known in the art, the guide shafts 17 open out toward the inside, which means they do not have four walls that form a closed chamber, but instead only three walls, which allows the guide lug 16 to be inserted into the guide shaft 17 from the side. Thus, the top container system 1 can be positioned only loosely onto the bottom (the other) container system 8 and can subsequently be pushed just far enough for the guide lug 16 to enter the guide shaft 17 of the other container system 8. This procedure is of advantage especially in cases in which the container systems are fully loaded and heavy, which would require considerable physical effort if they had to be lowered vertically with precision. These heavy container systems can now be simply positioned so as to be offset to the side and can subsequently be coupled to each other by pushing one side and lowering the other side.

The invention claimed is:

1. A container for use in an arrangement of multiple containers of the same type, said container comprising:

a lower container part and a cover;

at least two coupling recesses disposed within oppositely lying first walls that extend beyond an upper surface of the cover of the container; and at least two coupling hooks disposed on oppositely lying side walls of the container, the coupling hooks for interacting with associated coupling recesses of another container of the same type, wherein the coupling hooks are able to move between a coupled position, in which the coupling hooks are engaged in the coupling recesses of the other container, and a detached position, in which the coupling hooks are disengaged from the coupling recesses of the other container, each of the coupling hooks and each of the coupling recesses has two parts, the two parts of each of the coupling hooks being actuated via a shared actuation surface, a guide lug is disposed between the two parts of each of the coupling hooks, and a guide shaft is disposed between the two parts of each of the coupling recesses, each of the guide lugs for positioning engagement in an associated guide shaft of the other container, the guide lug being immobile with respect to the lower container part of the container, after placement of the container on top of the other container, one of the coupling hooks can be inserted in the horizontal direction into the associated coupling recess of the other container, and the oppositely lying coupling hook can subsequently be pushed vertically into the associated coupling recess of the other container, and each of the guide shafts has only three walls and is open toward the inside of the container such that the guide lug can be inserted into the associated guide shaft of the other container from the side, so as to allow the container to be positioned loosely onto the other container and subsequently pushed so that the guide lug enters the associated guide shaft of the other container.

2. The container of claim 1, wherein the first walls form part of the side walls of the lower container part.

3. The container of claim 1, wherein the first walls form part of the cover.

4. The container of claim 1, further comprising at least one spring, the actuation of the coupling hooks from the coupled position into the detached position taking place against the action of the at least one spring.

5. The container of claim 2, wherein in a region of the first walls, the cover flattens out toward the first walls.

6. The container of claim 1, wherein the cover is pivotably mounted on the lower container part.

7. A stackable container arrangement comprising a first container according to claim 1 and a second container according to claim 1.

8. The stackable container arrangement of claim 7, wherein the first walls of the second container form part of the side walls of the lower container part of the second container.

9. The stackable container arrangement of claim 8, wherein in a region of the first walls of the second container, the cover of the second container flattens out toward the first walls of the second container.

10. The stackable container arrangement of claim 7, wherein the second container further comprises at least one spring, the actuation of the coupling hooks of the second container from the coupled position into the detached position taking place against the action of the at least one spring.

11. The stackable container arrangement of claim 7, wherein the cover of the first container is pivotably mounted on the lower container part of the first cover and wherein the cover of the second container is pivotably mounted on the lower container part of the second cover.

* * * * *